US005364206A

United States Patent [19]

Marienfeld

[11] Patent Number: 5,364,206

[45] Date of Patent: Nov. 15, 1994

[54] SOIL STABILIZATION SYSTEM

[76] Inventor: Mark L. Marienfeld, 4821 Thornhill Dr., Acworth, Ga. 30101

[21] Appl. No.: 128,534

[22] Filed: Sep. 29, 1993

[51] Int. Cl.[5] ..... E02B 3/12

[52] U.S. Cl. ..... 405/16; 404/76; 405/15; 405/21; 405/258

[58] Field of Search ..... 405/262, 270, 15–21, 405/258; 404/76

[56] References Cited

U.S. PATENT DOCUMENTS 1,762,343 6/1930 Munster ..... 405/262
3,849,229 11/1974 Spillane et al. ..... 405/270 X
3,854,292 12/1974 Nienstadt ..... 405/270
3,949,113 4/1976 Draper et al. ..... 405/270 X
4,207,017 6/1980 Jarrell ..... 405/270
4,960,349 10/1990 Willibey et al. ..... 405/262

*Primary Examiner*—Dennis L. Taylor
*Attorney, Agent, or Firm*—Lyman R. Lyon

[57] ABSTRACT

A geotechnical mat for stabilizing soil and controlling erosion comprising a plurality of flat strips of tire tread oriented in a planar array, and means for connecting said strips to one another in said planar array.

1 Claim, 4 Drawing Sheets

SOIL STABILIZATION SYSTEM

FIELD OF THE INVENTION

This invention relates generally to a soil stabilization system and more particularly to a high strength flexible mat made from the tread portion of tires and usable for reinforcing earthen and civil engineering structures and for controlling soil erosion.

BACKGROUND OF THE INVENTION

At present, about one quarter of a billion tires are being discarded every year in the United States. It is estimated that two to six billion scrap tires are currently stockpiled. Landfill disposal of tires is impractical due to handling problems and the landfill space the tires consume. While federal and state agencies have focused on this problem, efforts to find a better solution to tire disposal or to recycle the tires have been unsuccessful.

Environmental regulations concerning the disposal of used automobile and truck tires are rapidly being legislated state by state in an effort to eliminate the landfill disposal of the tires. Most of the regulations include programs promoting the development of practical commercial products made from used tires. The success of recycling is based on the successful development of markets and uses for the recycled materials. It is, therefore, environmentally desirable and necessary to find a beneficial use for the used tires.

In the field of geotechnical engineering, there is an increasing need to impose manmade solutions on earth related projects to reinforce, improve, protect or beautify the earth. Shoreline protection against erosion is a typical example of the need for manmade protection of an earth structure. An unprotected shoreline can erode away due to current action, wave action or surface water runoff. As a shoreline erodes, valuable land is lost. Structures such as stream, lake or canal banks; slopes; dams; levees and jetties are often threatened or damaged. Movement of the eroded soil into the water is a form of water pollution.

Traditional solutions to shoreline protection, for example, retaining walls, seawalls, shoring, bulkheads, jetties, groins and revetment systems, are very expensive and limited in their use. Also, these systems do not include a light weight but strong flexible system which can be anchored to a slope.

The present invention offers a cost effective geotechnical engineering material which helps solve a waste tire disposal problem and offers a significant environmental contribution.

Therefore, the broad object of this invention is a high strength geotechnical engineering material constructed from the tread portion of tires and used for erosion control and soil stabilization and reinforcement.

A prior attempt to use whole tire casings along shorelines for erosion control is taught in and by U. S. Pat. No. 4,080,793. The system utilized whole tire casings to form an open system which is generally used in combination with a soil, aggregate or concrete fill to anchor the system. Such systems generally rely on the fill material within tire casings to be part of the final face of the erosion control system either with or without vegetation establishment in the fill material. Vegetation and fill are also used to help conceal the whole tire casings which are visually offensive. Early attempts of merely dumping whole tire casings for slope protection and erosion control were unsightly and environmentally unfriendly systems due to water retention and mosquito breeding in the tire casings. Another engineering use of waste tires is as shredded tire pieces used as fill in asphalt concrete or as road base material. However, by shredding the tire, the inherent strength of the reinforced tread portion of the tire is lost.

SUMMARY OF THE INVENTION

The broad object of this invention is a unique family of products which efficiently solve geotechnical engineering problems while also solving tire waste disposal problems. More specifically, the invention relates to a high strength flexible planar mat that utilizes the strength and structure of the existing tread and reinforcing belting of a tire.

According to the invention, a flexible planar mat structure is made up of layers of the tread portion of waste tires, connected to each other or woven together so as to form an erosion control type mat or a reinforcing type mat. The erosion control type mat is placed in contact with an erodible surface or is placed as part of a system against a surface to help control erosion due to wind or water. The reinforcing type mat is used to reinforce, stabilize, and improve earthen and civil engineering structures. The high strength of the individual tire tread strips provides the tire tread mat structure the strength necessary to allow the erosion control type mat to be effectively anchored in position and to allow the reinforcing type mat to perform its strengthening functions. The object of this invention offers a unique construction material which, because of its high strength, flexibility, and cost effective use of waste materials, surpasses that which is available today. The system of the invention can comprise one or more layers. The tread strips forming the flexible planar mat can be tightly orientated or large openings can be left between tire treads as needed. A geotextile can be incorporated into the tire tread mat or can be placed above or below the installed mat.

DETAILED DESCRIPTION OF THE PREFERRED EMBODIMENT(S)

Figure 1:
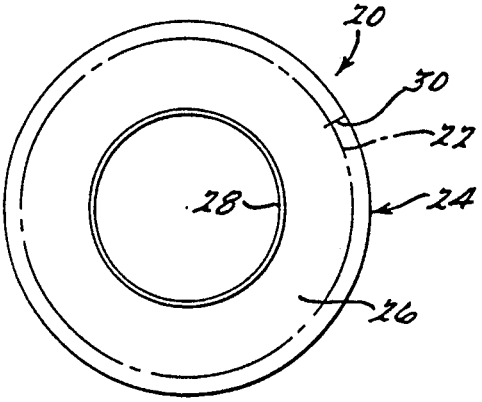
FIG. 1 is an elevational view of a waste tire, a dashed line depicting the cut made to extract the tread portion of the tire from the sidewall and bead.

Referring to FIG. 1, a typical waste tire 20 is cut along a dashed line 22 to extract a tread portion 24 from a sidewall 26 and bead 28. The tread portion 24 of the tire 20 is also cut at line 30, to allow the tire tread strip 24 to lie flat.

Figure 2:
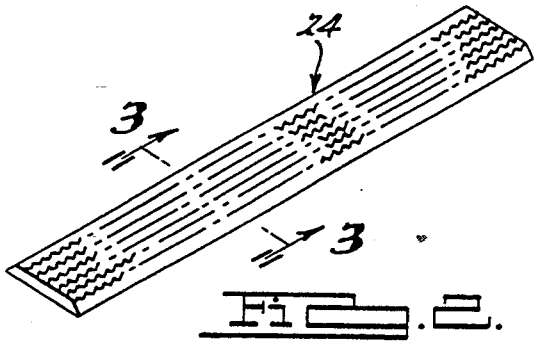
FIG. 2 is a perspective view of the flat tire tread after extraction thereof from the whole tire casing of FIG. 1.

As seen in FIG. 2 the flattened tire tread strip 24 is of rectangular configuration after extraction from the whole tire 20. The size and thickness of the individual tire tread strip 24 will vary based on the size, tread wear or thickness of the waste tire 20.

Figure 3:
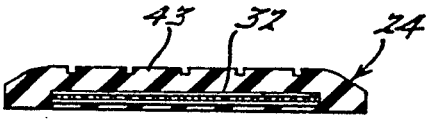
FIG. 3 is a cross-sectional view taken along the line 3—3 of FIG. 2.

As seen in FIG. 3 the reinforcing belts 32 within the tire tread strip 24 are utilized to strengthen and stabilize the tread strip. The tread side 43 of the tire tread strip 24 is facing upward.

Figure 4:
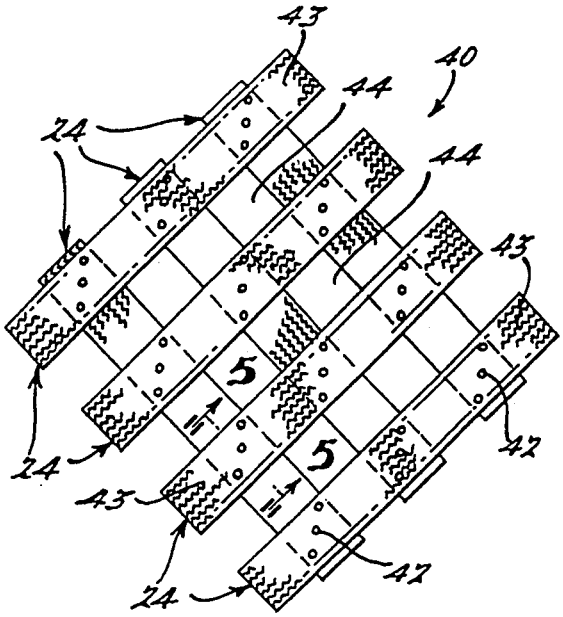
FIG. 4 is a top plan view of a flexible planar mat made from two layers of tire tread strips connected together.
Figure 5:
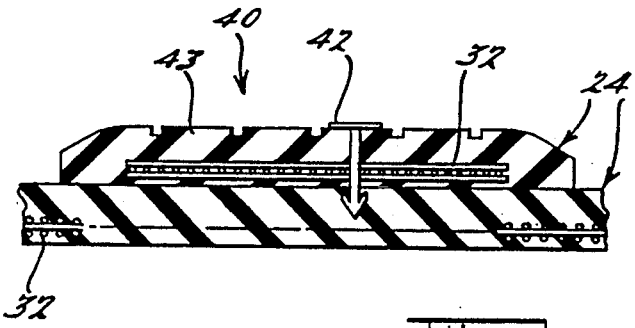
FIG. 5 is a view taken along the line 5—5 of FIG. 4.

FIGS. 4 and 5 disclose an exemplary embodiment of a flexible planar mat structure 40 made from two layers of tire tread strips 24 connected in a rectangular array as by pins 42. In this embodiment of the invention, two layers of tire tread strips 24 are laid perpendicular to one another with the tread sides 43 facing upwardly and are mechanically secured to one another as by pins 42. Alternatively, a chemical or thermal bond can be utilized between the tire tread strips 24. Similar mats 40 can be made using additional layers of the tire tread strips 24 of different size and/or positioned in different orientations or spacings. For example, the tread sides 43 of the lower layer strips may be faced downwardly if desired. For additional strength of the mechanical connection shown in FIG. 5, the fastening pin 42 could penetrate the layers of reinforcing belting 32 in both tire tread strips 24.

As seen in FIG. 4, the tread strips 24 are connected so as to define substantial openings 44 between the tire tread strips 24. Again, variations of this embodiment can be made by varying the size of the openings 44 in the different layers.

Figure 6:
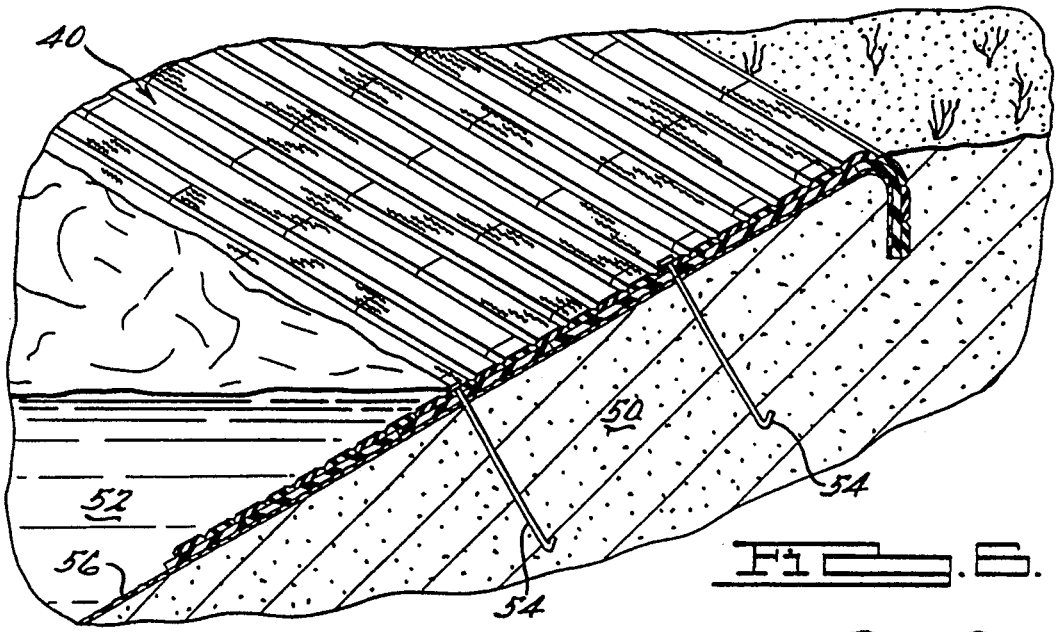
FIG. 6 is a perspective view, partially in cross-section, of a tie-back anchored flexible planar mat structure placed at the interface of a soil bank and water as a protective layer to minimize shore erosion.

FIG. 6 is a cross-sectional view of an application of the flexible planar mat 40 to the interface of a soil or rock bank 50 and water 52 as a protective layer to minimize shore erosion. The mat 40 is shown with two layers of tightly spaced tire tread strips 24, the bottom layer being oriented perpendicular to the slope and the shoreline and the top layer being oriented parallel to the slope and shoreline. A plurality of tie-back anchors 54 (many types available in practice) extend through the flexible planar mat 40 into the bank 50 to keep the mat 40 from moving and to keep it in intimate contact with the slope surface. It is to be noted that a filtering geotextile 56 can be used to enhance the performance of the system.

Figure 7:
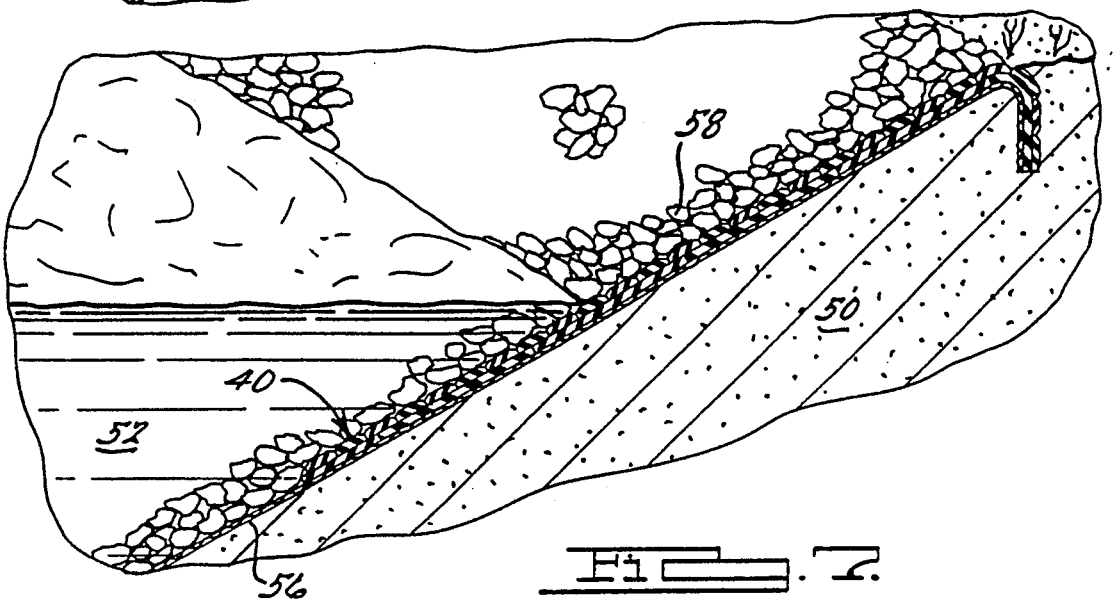
FIG. 7 is another embodiment of the flexible planar mat covered by rip-rap stone to anchor the mat.

As seen in FIG. 7, an optional layer of rip-rap stone 58 is shown above the mat covered slope as weight for ballasting and for additional wave energy dissipation in this area.

Figure 8:
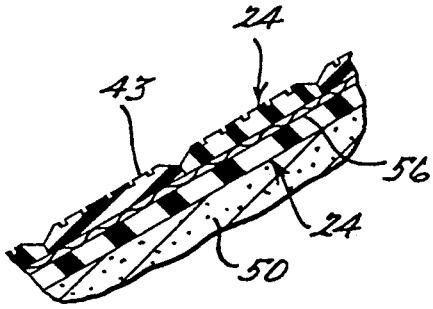
FIG. 8 is a cross-sectional view of the flexible planar mat with a geotextile fabric interposed between tire tread layers.

FIG. 8 discloses one embodiment of a geotextile 56 being used in conjunction with a flexible planar mat 40. In this embodiment, the geotextile 56 is oriented between layers of the tire tread strips 24.

Figure 9:
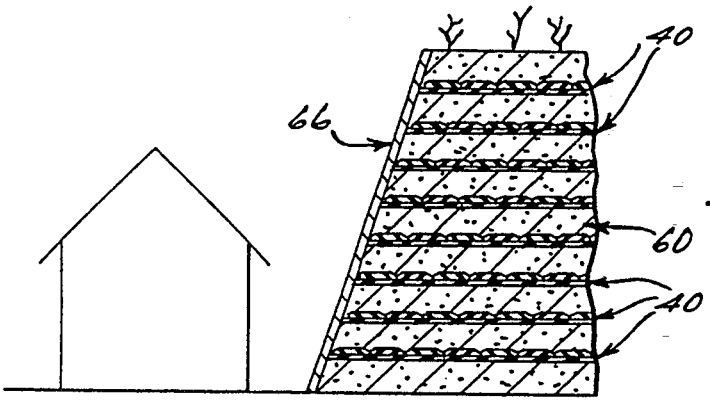
FIG. 9 is a cross-sectional view showing parallel layers of flexible planar mat placed within a soil slope to function as reinforcement to stabilize the slope.

FIG. 9 is a cross-sectional view of multiple layers of mat 40 that function as reinforcement layers to stabilize a slope 60. Various configurations of embodiments of the flexible planar mat 40 could be used in the application with various slope or wall facing embodiments 66.

Figure 10:
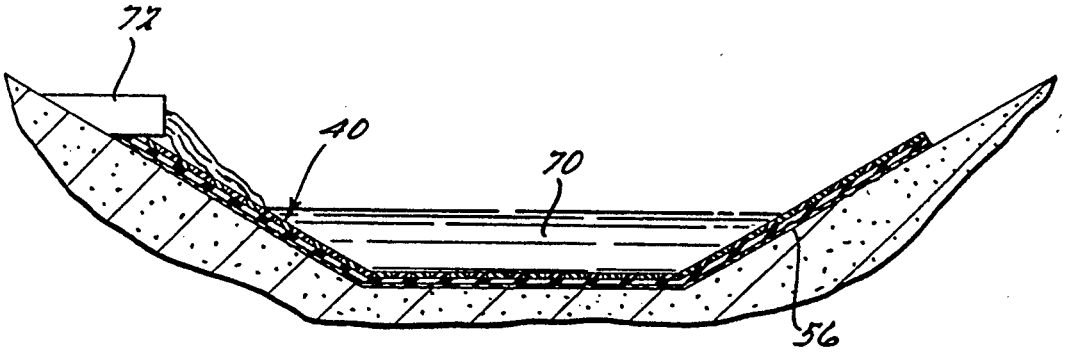
FIG. 10 is a cross-sectional view of the flexible planar mat used as a liner for a stream or canal.

FIG. 10 illustrates use of the mat 40 as a liner and protective layer to prevent erosion and scour along a stream or canal 70 as well as to preclude localized erosion associated with an outlet, outfall or gutter structure 72.

Figure 11:
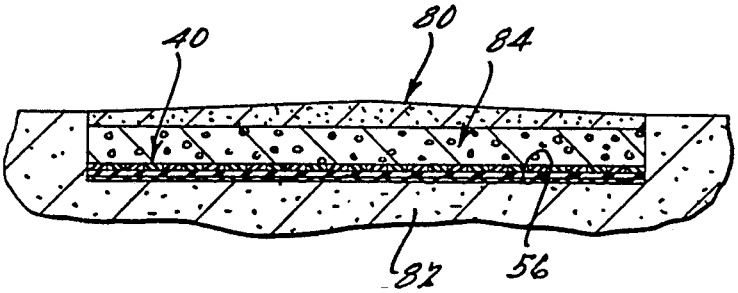
FIG. 11 is a cross-sectional view of the flexible planar mat used to reinforce and stabilize a pavement structure.

As seen in FIG. 11, the flexible planar mat 40 is used to reinforce and stabilize soil underlying a pavement section 80. The mat 40 in this example is shown overlying subgrade soil 82 and having an underlying geotextile layer 56. The mat 40 is overlaid by a crushed stone base aggregate layer 84. Various configurations of embodiments of the flexible planar mat 40 can be used in this and related applications where the flexible planar mat 40 reinforces and stabilizes a pavement, an unpaved road or yard, or an embankment by being placed beneath or within the structure.

Figure 12:
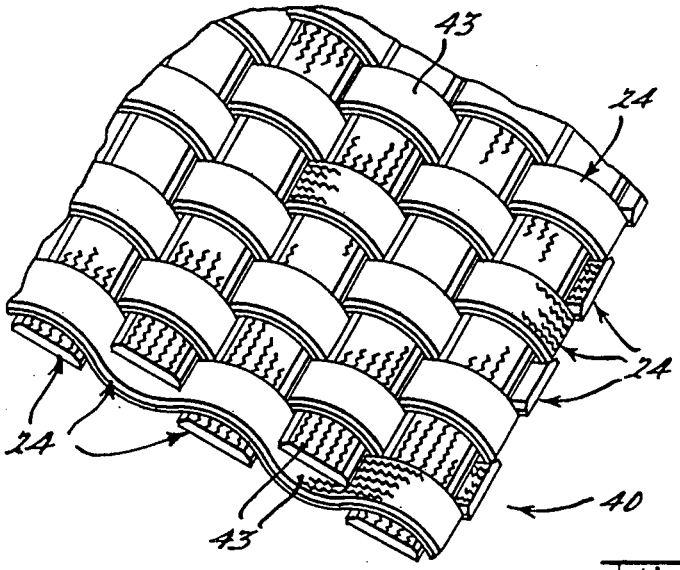
FIG. 12 is a perspective view of a flexible planar mat made by weaving together the tire tread strips.

FIG. 12 depicts yet another embodiment of the tire tread mat 40 in which the tire tread strips 24 are woven together into a tightly spaced planar array which maintains its integrity due to the high degree of friction between strips.

Figure 13:
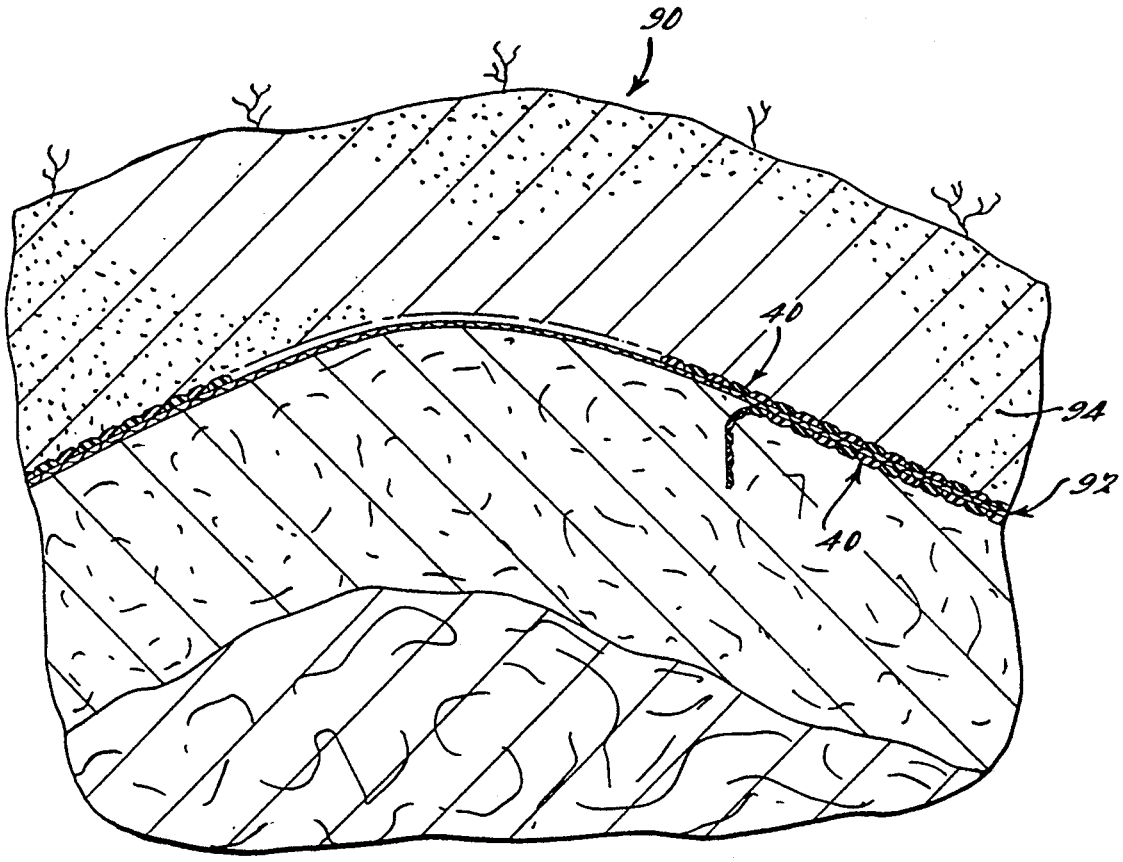
FIG. 13 is a cross-sectional view of the mats utilized in stabilizing a sanitary landfill.

FIG. 13 is a cross-sectional view of a landfill cap 90 which comprises an impermeable geomembrane system 92

I claim:

1. A mat for erosion control, structural reinforcement and stabilization of soil comprising:

a plurality of flat elongated generally rectangular tread strips comprising the tread portion of tires from which the sidewalls have been removed, each of said tread strips having the original tread reinforcing belts extending the full length thereof and disposed internally thereof, said tread strips being oriented in a planar array with a first plurality of said tread strips extending parallel to one another in spaced relation and a secondary plurality of said tread strips extending in parallel relation to one another in spaced relation and at right angles to said first plurality of strips so as to form a flexible mat having discrete openings therein, and means for mechanically connecting said tread strips to one another for maintaining said planar array.

* * * * *